US006309127B1

(12) United States Patent
Salemme

(10) Patent No.: US 6,309,127 B1
(45) **Date of Patent: *Oct. 30, 2001**

(54) CAPS FOR WRITING INSTRUMENTS

(75) Inventor: James L. Salemme, Billerica, MA (US)

(73) Assignee: Berol Corporation, Freeport, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/306,898

(22) Filed: May 7, 1999

(51) Int. Cl.[7] ..... B43K 23/08
(52) U.S. Cl. ..... 401/213; 401/243
(58) Field of Search ..... 401/202, 213, 401/243, 245, 247

(56) References Cited

U.S. PATENT DOCUMENTS

| | | | | |
|---|---|---|---|---|
| 4,086,011 | * | 4/1978 | Kuparinen | 401/213 |
| 4,380,403 | | 4/1983 | Endres et al. | 401/213 |
| 4,558,966 | | 12/1985 | Mikuteit | 401/213 |
| 4,643,605 | | 2/1987 | Iwasaki | 401/213 |
| 4,844,642 | | 7/1989 | Inaba et al. | 401/213 |
| 5,000,604 | * | 3/1991 | Isoda | 401/202 |
| 5,054,949 | * | 10/1991 | Heger | 401/202 |
| 5,066,156 | | 11/1991 | Petrillo et al. | 401/213 |
| 5,127,754 | | 7/1992 | Mase | 401/202 |
| 5,186,564 | | 2/1993 | Fuhrmann, III et al. | 401/202 |
| 5,362,169 | | 11/1994 | Hamamoto et al. | 401/213 |
| 5,441,356 | | 8/1995 | Cho | 401/247 |
| 5,762,435 | | 6/1998 | Fukushima | 401/213 |
| 5,957,608 | | 9/1999 | Matsumoto et al. | 401/202 |
| 5,975,783 | * | 11/1999 | Hu | 401/202 |

FOREIGN PATENT DOCUMENTS

| | | | |
|---|---|---|---|
| 208239 | | 6/1993 | (CN) . |
| 1915566 | | 3/1969 | (DE) . |
| 3343001 A1 | | 6/1985 | (DE) . |
| 2 229 967 | | 10/1990 | (GB) . |
| 2 067 960 A | | 8/1991 | (GB) . |
| 2-5994 | * | 2/1990 | (JP) ..... 401/202 |

* cited by examiner

*Primary Examiner*—David J. Walczak
(74) *Attorney, Agent, or Firm*—Marshall, Gerstein & Borun

(57) ABSTRACT

Caps are provided for covering the writing end of a writing instrument containing a non-solid writing material. The caps include a cap body having an open end for receiving the writing end and a closed end for covering the writing end and having a long axis extending from the open end to the closed end, and a sealing member disposed within the cap body, a portion of which is fixed axially relative to the long axis of the cap body. In some caps, the cap body defines an air flow passage extending from the open end to the closed end.

16 Claims, 9 Drawing Sheets

CAPS FOR WRITING INSTRUMENTS

BACKGROUND OF THE INVENTION

The invention relates to caps for writing instruments, e.g., caps for ball point pens.

Writing instruments that contain liquid ink often include caps to prevent the ink from drying out. Such caps are sometimes provided with vent holes at the closed end. These vent holes reduce the pressure exerted on the ink within the writing instrument when the cap is applied, reducing the likelihood that ink will leak from the pen due to the pressure differential caused by applying and removing the cap in a normal manner. Also, if the cap is swallowed by a small child the vent holes may allow the child to breathe with the cap lodged in the child's throat. These vent holes may allow air to flow past the pen tip and cause the ink at the tip to dry out.

One problem that is sometimes encountered with pen caps is "cap pump". This is a phenomenon that occurs when a user of the pen repeatedly pumps the cap on and off of the pen tip. This pumping forces air into the pen through an air vent that is normally provided on the side of the pen tip. The air then travels into the ink reservoir of the pen, displacing ink which then travels up to the tip and out through the air vent. Thus, ink may undesirably "burp" out of the tip and into the cap.

SUMMARY OF THE INVENTION

The invention provides caps for writing instruments that provide a close seal against the pen tip to prevent the ink at the tip from drying out. Preferred caps also minimize pressure build-up when the cap is pumped on and off of a pen, preventing cap pump under most circumstances. Preferred caps include a sealing member having a portion that is fixed axially relative to the cap body. Because the sealing member as a whole does not move axially between two positions, the caps are relatively simple and economical to manufacture, and are resistant to failure. In preferred caps, the cap is vented and the sealing member is constructed so that an air passageway is provided along the long axis of the cap at all times, to allow a child to breathe if the cap is swallowed.

The invention features caps for covering the writing end of a writing instrument containing a non-solid writing material.

In one aspect, the caps include a cap body having an open end for receiving the writing end, a closed end for covering the writing end, and a long axis extending from the open end to the closed end. The cap further includes a sealing member, disposed within the cap body, a portion of which is fixed axially relative to the long axis of the cap body.

Preferred caps include one or more of the following features. The cap body defines an air flow passage extending from the open end to the closed end. The sealing member includes a cushioning portion constructed to resiliently deflect in response to pressure exerted by the tip of the writing instrument when the cap is applied. The cushioning portion includes a thermoplastic elastomer. The sealing member further includes a sealing cap for receiving the tip of the writing instrument in sealing engagement. The sealing cap has a volume of less than 50 $mm^3$. The sealing cap includes a frustroconical or hemispherical portion at its closed end, to closely surround the tip of the writing instrument. The diameter of the open end of the sealing cap is substantially equal to the diameter of a rim portion of the writing instrument. The sealing member includes one or more air vents to allow passage of air through the sealing member along the air flow passage. The sealing member is fixed by an interference fit with a portion of the inner wall of the cap body. The closed end of the cap body includes one or more air vents which remain open when the cap is in place on a writing instrument.

In another aspect, the caps include a cap body having an open end for receiving the writing end, a closed end for covering the writing end, and a long axis extending from the open end to the closed end, the cap body defining an air flow passage extending from the open end to the closed end. The cap further includes a sealing member disposed within the cap body, the sealing member being constructed to resiliently deflect towards the closed end during insertion of the writing end into the open end without closing or blocking the air flow passage.

In another aspect, the caps include a cap body having an open end for receiving the writing end, a closed end for covering the writing end, and a long axis extending from the open end to the closed end. The cap further includes a sealing member, disposed within the cap body, that is constructed to resiliently deflect axially towards the closed end, during insertion of the writing end into the open end, to limit compression of the air within the sealing member, and to return to its normal position when the cap is removed from the pen. Preferably, compression of the air is sufficiently limited so that cap pump is substantially prevented even after repeated pumping of the cap on and off.

Preferred implementations of these caps include one or more of the preferred features discussed above.

The invention also features methods of covering the writing end of a writing instrument using caps of the invention, and writing instruments that include caps of the invention.

Other features and advantages will become apparent from the following Description of the Preferred Embodiments, the drawings and the claims.

DESCRIPTION OF THE PREFERRED EMBODIMENTS

Figure 1:
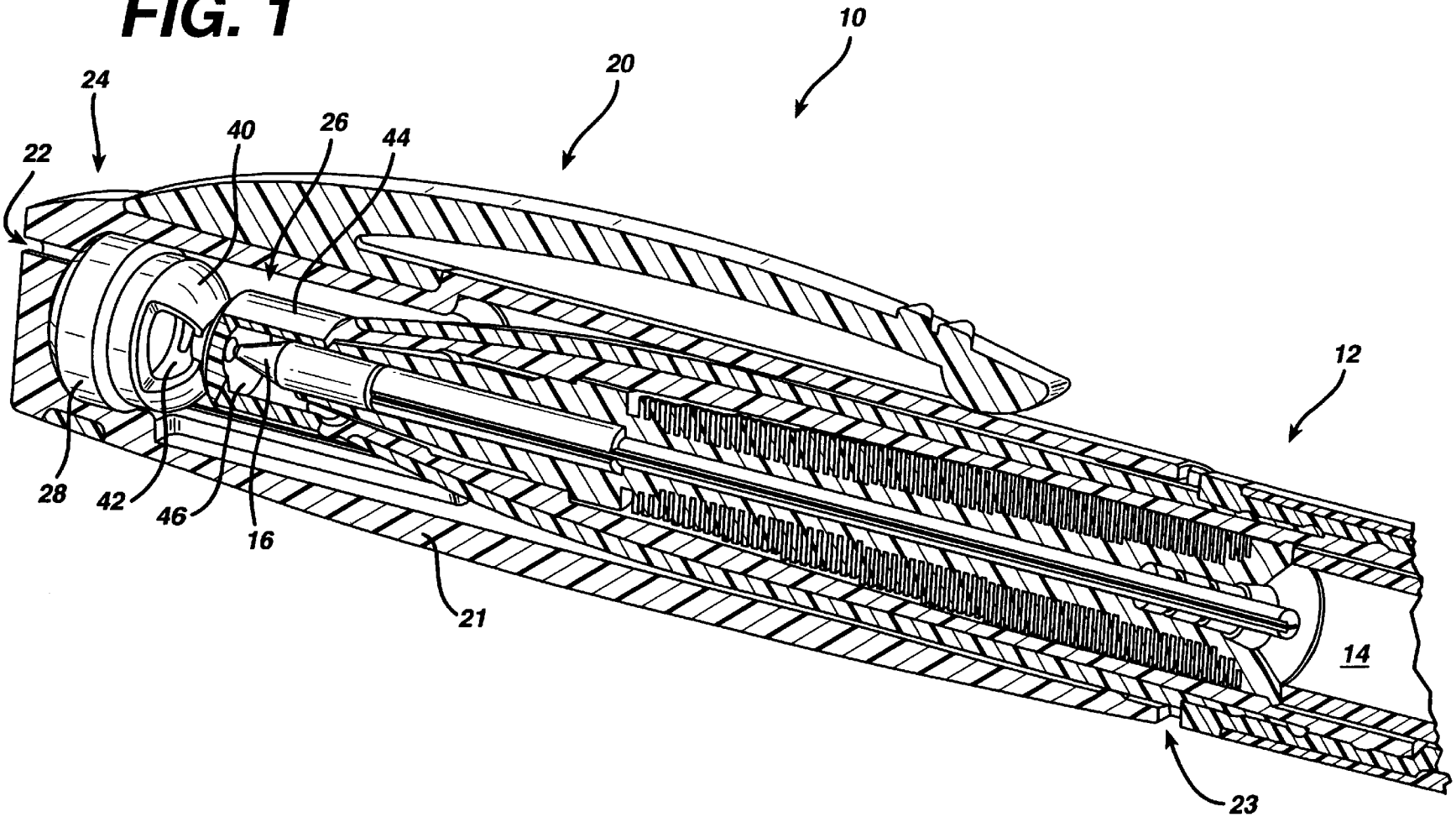
FIG. 1 is a cut-away perspective view of a portion of a writing instrument with a vented cap according to one aspect of the invention.

Referring to FIG. 1, pen 10 includes a pen body 12 containing an ink reservoir 14 in fluid communication with a pen tip 16. A pen cap 20 is mounted on the pen 10, covering the pen tip 16. Pen cap 20 includes a cylindrical cap body 21 having an open end 23 and a closed end 24. Closed end 24 includes a plurality of air vents 22 to provide an air pathway from the open end 23 to the closed end 24.

Pen cap 20 further includes a sealing member 26 for receiving pen tip 16 in sealing engagement when the pen cap is applied to the pen. Sealing member 26 is co-molded with a mounting member 28 that is press-fit into the closed end 24 of the cap body 21 and is fixed against axial movement relative to the cap body by this press-fit. Mounting member 28 is preferably a non-elastomeric material, e.g., polypropylene.

Sealing member 26 includes a resiliently deflectable cushioning member 40 that is constructed to resiliently deflect towards the closed end of the cap in response to pressure by the pen tip 16 when the cap is applied to the pen. Cushioning member 40 includes a pair of vent holes 42 to allow passage of air through the sealing member and thus provide an air flow passage from the open end 23 to air vents 22 in the closed end 24. Vent holes 42 are also constructed to enhance the ability of the cushioning member 40 to deflect towards the closed end of the cap in response to forward pressure exerted by the pen tip 16 when the cap is applied. Because of the presence of the vent holes 42, the cushioning member 40 can be formed of a relatively stiff material. This allows the cushioning member to be formed integrally with the sealing cap 44, discussed below, which must be fairly rigid. The cushioning member can include more vent holes, if desired, e.g., three equally spaced openings.

Figure 1A:
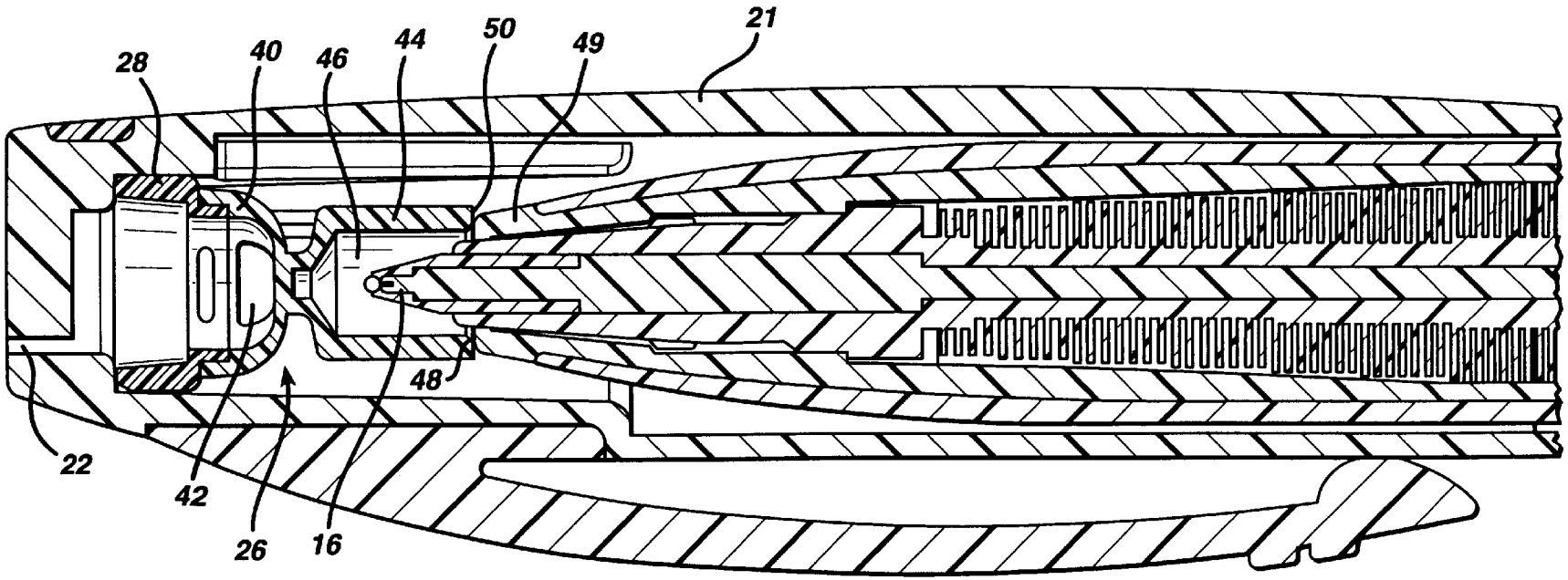
FIG. 1A is an axial cross-sectional view of the writing instrument of FIG. 1.
Figure 3:
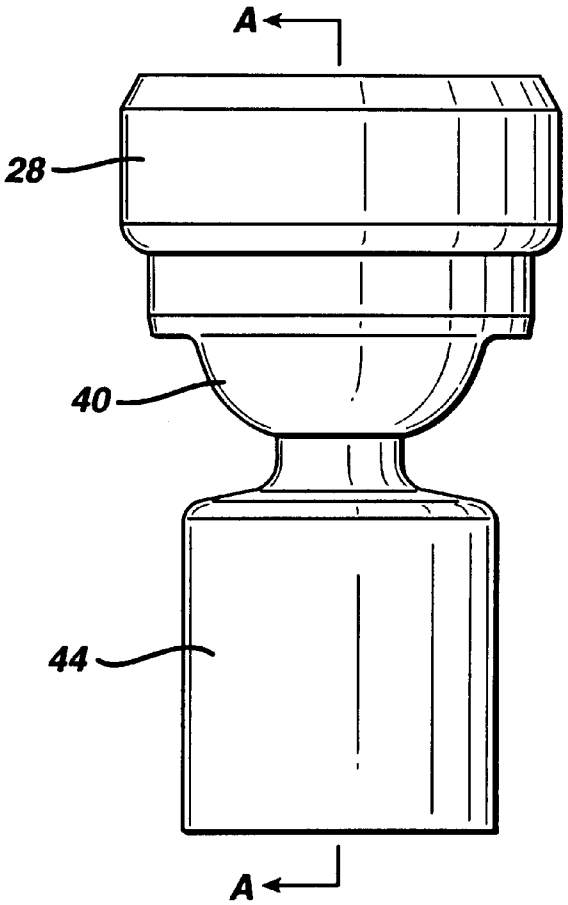
FIG. 3 is a plan view of the assembly shown in FIG. 2, taken from a second direction, 90 degrees from the first direction of FIG. 2.
Figure 2:
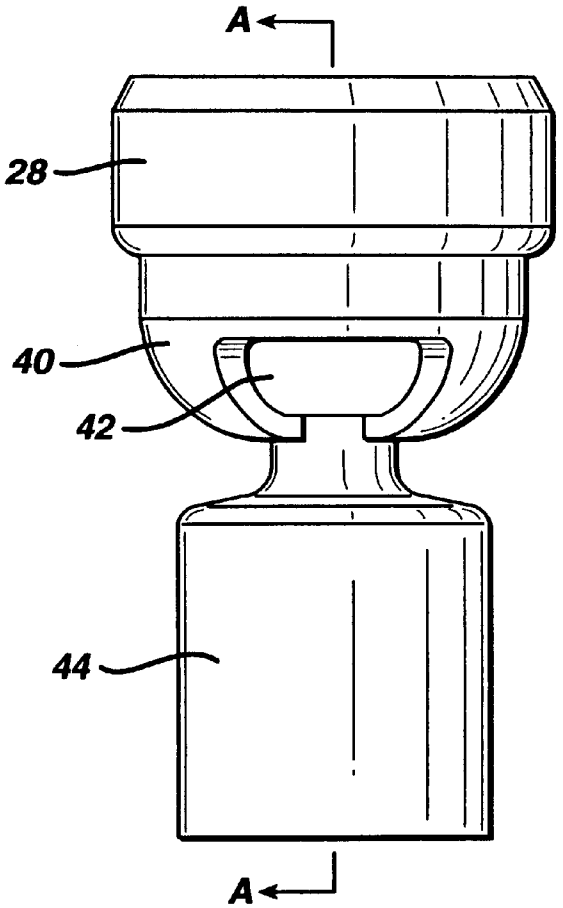
FIG. 2 is a plan view of the co-molded sealing member/mounting member assembly of the vented cap of FIG. 1, taken from a first direction.
Figure 3A:
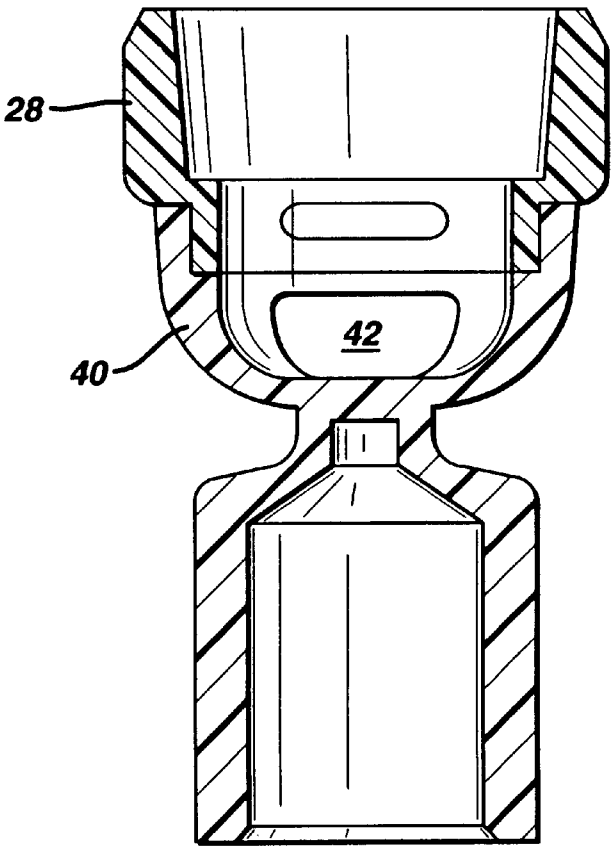
FIG. 3A is an axial cross-sectional view of the assembly taken along line A—A in FIG. 3.

Sealing member 26 also includes a sealing cap 44, extending from the center of cushioning member 40, which defines a cylindrical cavity 46 for receiving pen tip 16 in sealing engagement. (Sealing cap 44 is partially cut away in FIG. 1, to show the pen tip. The intact sealing cap is shown in FIGS. 2 and 3.) Sealing cap 44 seals the pen tip 16 to prevent drying of the ink, while vent holes 42 continue to allow passage of air through the cap body. Sealing cap 44 is preferably formed integrally with the cushioning member 40, as shown. The open end of sealing cap 44 has a diameter that corresponds to the diameter of rim 48 of pen 10, so that when the pen tip is inserted into the cavity 46 rim 48 abuts edge 50 of cap 44 (see FIG. 1A) and acts as a detent, preventing further movement of the pen tip into the cavity. This engagement also causes the cushioning member 40 to deflect forward as further pressure is applied during insertion of the pen into the cap. Alternatively, the diameter of sealing cap 44 may be slightly larger, so that edge 50 will contact and seal against the tapered circumferential surface 49 of the pen. Seating against surface 49, rather than rim 48, will tend to accommodate manufacturing tolerances in the dimensions of the parts, providing more uniform seating and a self-centering action.

Figure 2A:
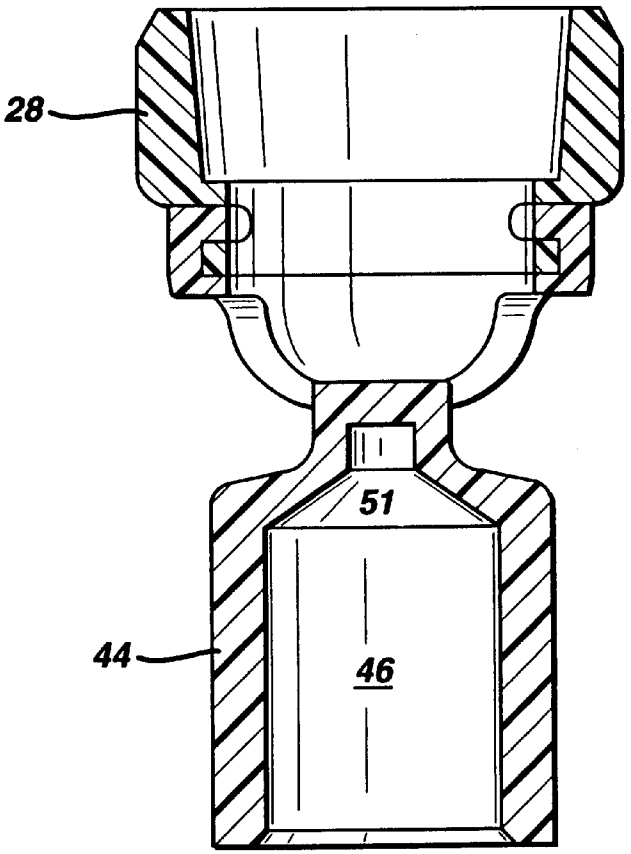
FIG. 2A is an axial cross-sectional view of the assembly of FIG. 2, taken along line A—A.

The closed end 51 of the cavity is substantially frustroconical (see FIG. 2A), to minimize the air space around the pen tip and thus minimize the amount of air that can be compressed. The total volume of cavity 46 is preferably less than about 50 $mm^3$. Advantageously, the small area of cavity 46, combined with the sealing engagement of rim 48 or surface 49 against edge 50, prevent ink drying without requiring that the entire cap be sealed against air flow.

The deflection of the cushioning member towards the closed end of the pen, in combination with the provision of an air flow passage from the open end to the closed end of the cap, minimizes compression of air within the cavity during application of the cap or pumping of the cap on and off, thus making it easy to apply the cap to the pen and preventing or lessening cap pump. Also, the axial movement of the cushioning member allows for a positive seal over a range of dimensions of the pen and/or cap resulting from manufacturing tolerances.

Figure 4:
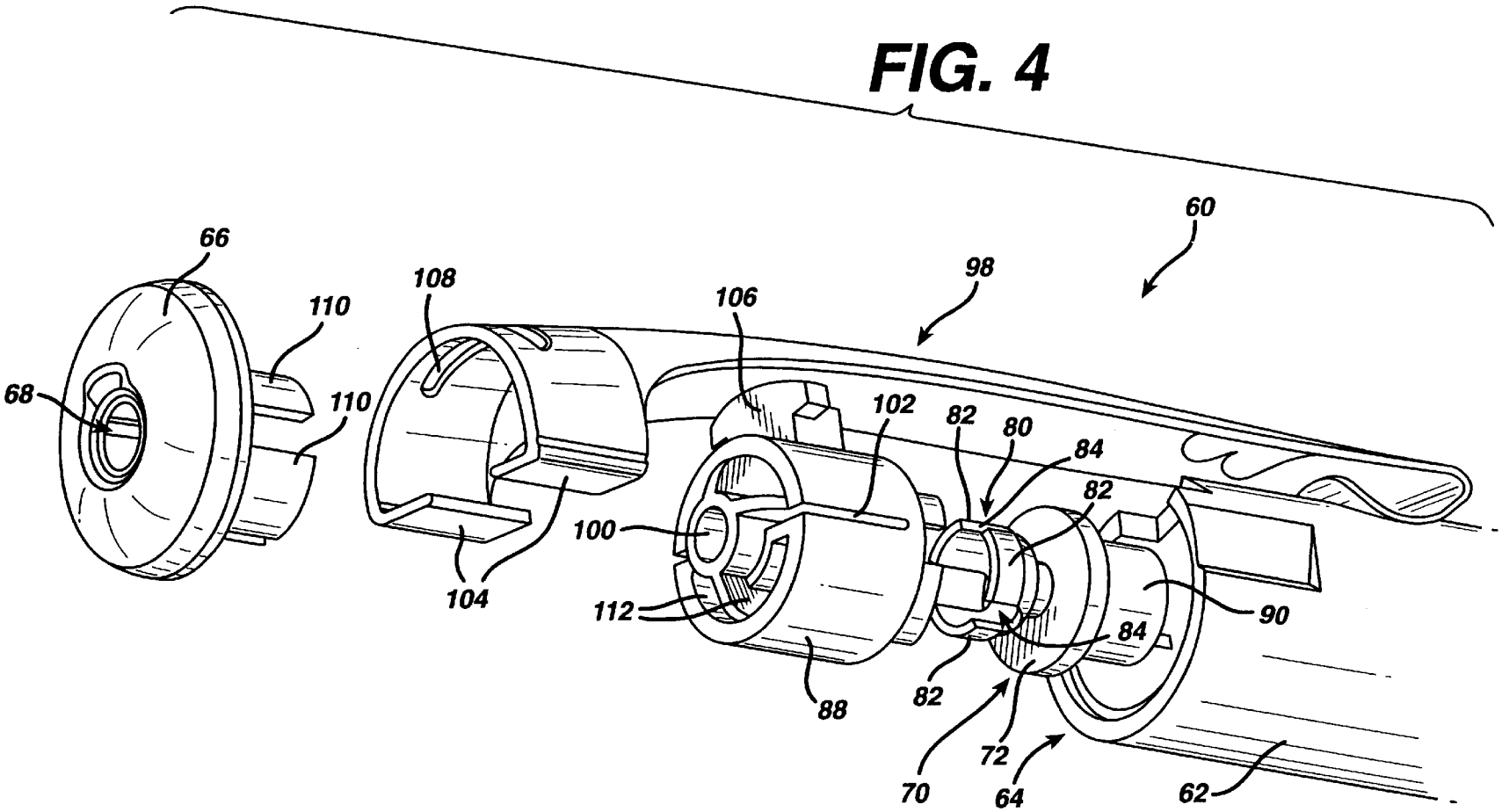
FIGS. 4 and 4A are exploded views of a vented cap according to an alternate embodiment of the invention, taken in different directions.
Figure 4A:
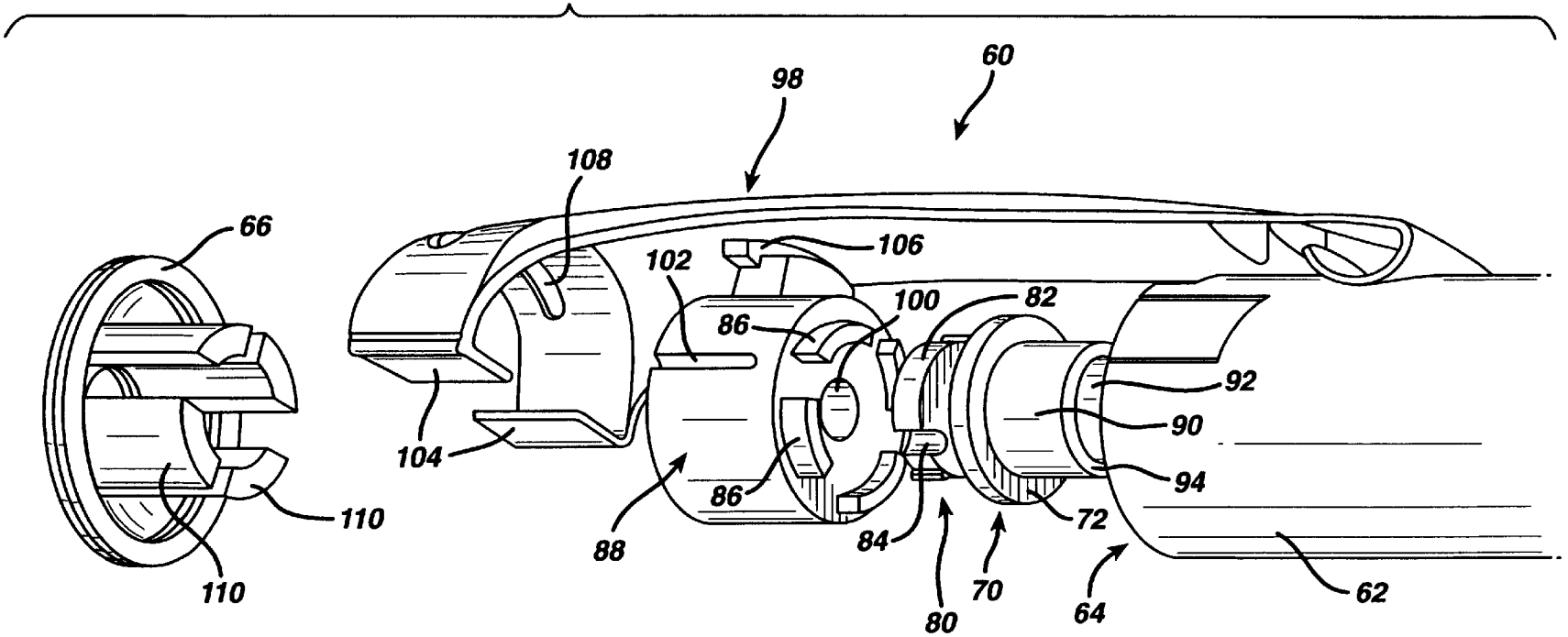
Figure 5:
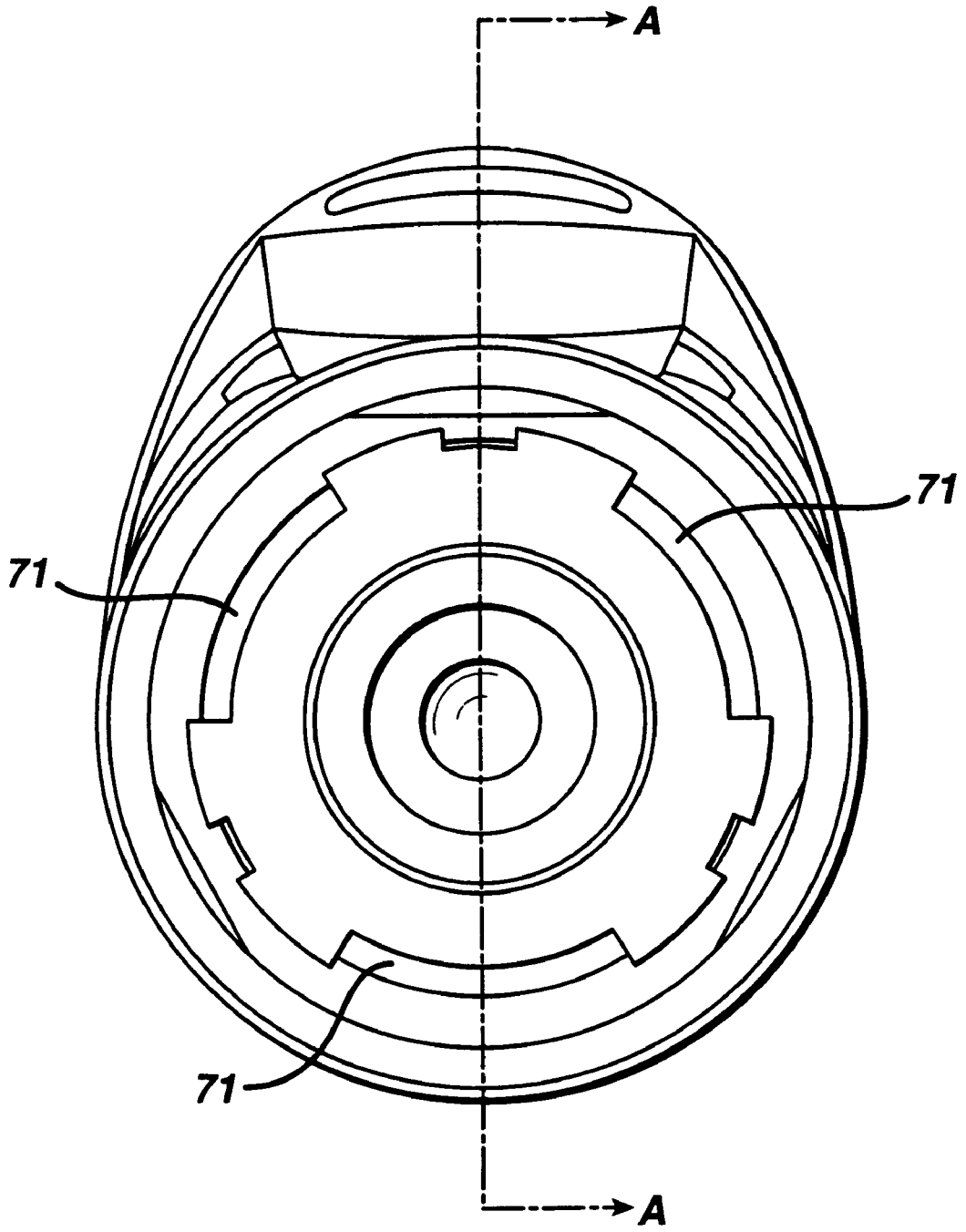
FIG. 5 is an end view of the vented cap shown in FIG. 4.
Figure 5A:
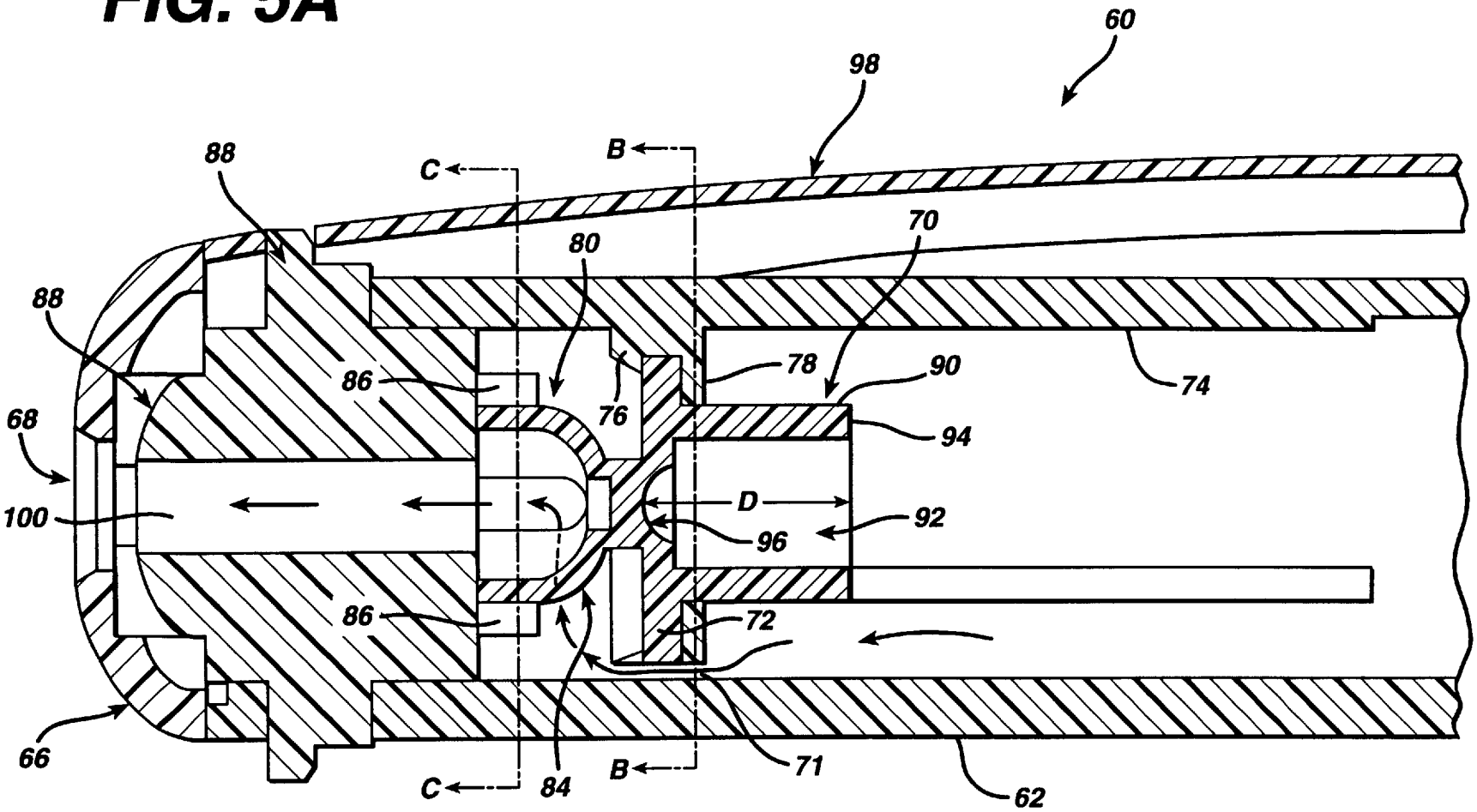
FIG. 5A is a cross-sectional view of the vented cap, taken along line A—A in FIG. 5.
Figure 5B:
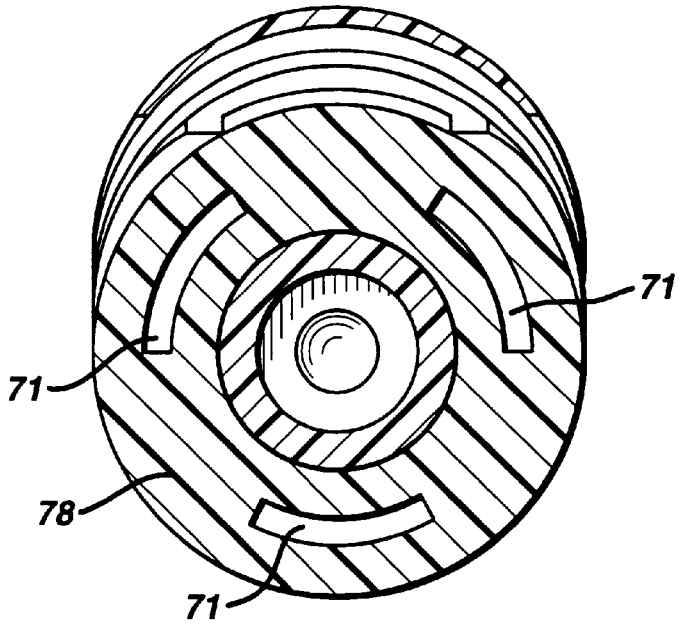
FIGS. 5B and 5C are cross-sectional views taken along lines B—B and C—C, respectively, in FIG. 5A.
Figure 5C:
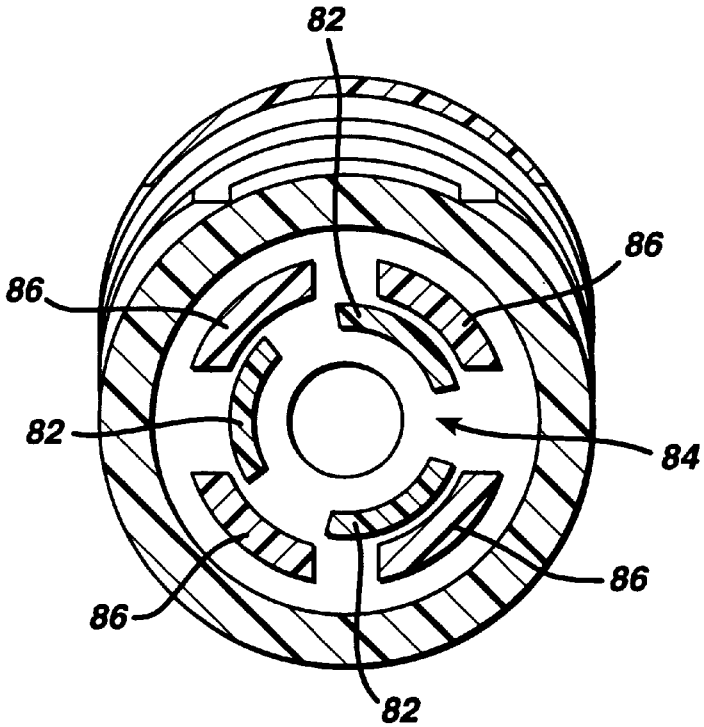

A vented cap 60, according to an alternate embodiment of the invention, is shown in FIGS. 4–5C. Referring to FIGS. 4, 4A and 5A, cap 60 includes a cylindrical cap body 62 having an open end 64 and a cover 66 to seal open end 64. Cover 66 includes a vent 68 to allow flow of air from one end of the cap to the other, as discussed above with reference to FIG. 2.

Cap 60 includes a sealing member 70 for receiving pen tip 16 in sealing engagement when the pen cap is applied to the pen. Sealing member 70 includes a disc 72 that is mounted on the inner wall 74 of the cap body 62 and fixed against axial movement relative to the inner wall 74 by an interference fit between a circumferential ridge 76 and a shoulder 78 that extend inwardly from wall 74 (FIG. 5A). The shoulder 78 includes a plurality of vent holes 71, to allow passage of air through shoulder 78 and past disc 72. Disc 72 includes a resiliently deflectable cushioning member 80 (FIG. 4) that includes three legs 82 that are spaced so as to define vent holes 84 to allow passage of air through the sealing member. Legs 82 fit within the axially extending flanges 86 of the cap housing 88 (see FIGS. 4A and 5A). Legs 82 and flanges 86 are arranged so that regardless of the relative orientation of the legs and flanges during assembly, an air passage will always be provided through at least a portion of one of the vent holes. The flanges 86 prevent the legs from splaying outward when forward pressure is exerted by the pen tip 16 as the cap is applied to a pen. Instead, legs 82 deflect in the same manner as cushioning member 40, described above, with the vent holes 84 functioning in the same manner as vent holes 42. Thus, the presence of vent holes 84 enhances the ability of the cushioning member 80 to deflect in response to forward pressure exerted by the pen tip 16 when the cap is applied.

Clip housing 88 includes a longitudinal bore 100 for passage of air therethrough, so that air can pass from the open (pen-receiving) end of the cap through the sealing member via vent holes 84, through the clip housing 88 via bore 100, and out the closed end of the cap through cover 66 via vent 68. Thus, a continuous air flow path is provided along the longitudinal axis of the cap.

Sealing member 70 also includes a sealing cap 90 that extends rearwardly from disc 72 and defines a cavity 92 for receiving pen tip 16 in sealing engagement. Sealing cap 90 may be formed integral with the disc 72, as shown, or may be a separate part that is mounted on disc 72. The open end of sealing cap 90 has a diameter that corresponds to the diameter of rim 48 of pen 10, so that when the pen tip is inserted into the cavity 90 rim 48 abuts edge 94 of cap 90 and acts as a detent, preventing further movement of the pen tip into the cavity. As discussed above with reference to FIG. 1A, alternatively, the sealing cap 90 may have a slightly larger diameter, so that edge 94 seals against the tapered circumferential surface of the pen. The depth D of the cavity is selected so that when the pen tip is fully inserted into the cavity the tip is very close to, but not touching, the closed end of the cavity. The closed end of the cavity includes a substantially hemispherical portion 96 to provide a minimal air space around the pen tip 16.

Cap 60 further includes a clip 98, retained by the aforementioned clip housing 88. Referring to FIGS. 4 and 4A, clip housing 88 includes a pair of slots 102 that are dimensioned to receive arms 104 of clip 98, and a tab 106 that is received by aperture 108 of the clip in an interference fit. After the clip has been mounted in this manner, cover 66 is pressed onto the clip housing so that its legs 110 are press fit into openings 112 of the clip housing.

In both embodiments, the sealing member is formed of a resilient material that is capable of repeatedly deflecting in response to pressure when the pen cap is applied, then returning to its normal position. Suitable materials include thermoplastic elastomers such as styrene butadiene block copolymers, commercially available from Shell under the tradename KRATON, e.g., KRATON 77-20 copolymer. Preferably, the resilient material has a hardness of less than 60 Shore A, more preferably about 40–60 Shore A.

Other embodiments are within the claims. For example, rather than press-fitting the sealing member into the cap, as shown in FIG. 1 and described above, the sealing member can be mounted in any desired manner that will resist axial movement, e.g., by an interference fit.

What is claimed is:

1. A cap for covering the writing end of a writing instrument containing a non-solid writing material, comprising:

a cap body having a first end for receiving the writing end, a second end for covering the writing end, a long axis extending from the first end to the second end, and an air vent, the cap body defining an air flow passage extending from the first end to the second end and the air vent in communication with the air flow passage; and a sealing member disposed within the cap body, a portion of the sealing member being fixed axially relative to the long axis of the cap body, the sealing member including a sealing cap for receiving the tip of the writing instrument and a cushioning portion, the sealing cap defining a sealed volume around the tip and the cushioning portion being constructed to resiliently deflect axially towards the second end without blocking the air vent when the cap is in place on a writing instrument.

2. The cap of claim 1 wherein the cushioning portion comprises a thermoplastic elastomer.

3. The cap of claim 1 wherein the sealing cap includes a frustroconical or hemispherical portion at its closed end, to closely surround the tip of the writing instrument.

4. The cap of claim 1 wherein the diameter of the open end of the sealing cap is substantially equal to the diameter of a rim portion of the writing instrument.

5. The cap of claim 1 wherein the sealing member includes one or more air vents to allow passage of air through the sealing member along the air flow passage.

6. The cap of claim 1 wherein the sealing member is fixed by an interference fit with a portion of an inner wall of the cap body.

7. The cap of claim 1 wherein the sealing member and cushioning portion are a single, integral member.

8. A cap for covering the writing end of a writing instrument containing a non-solid writing material, comprising:

a cap body having a first end for receiving the writing end, a second end for covering the writing end, and an air vent; and a sealing member disposed within the cap body including a sealing cap for receiving the tip of the writing instrument and a cushioning portion, the sealing cap defining a sealed volume around the tip and the cushioning portion constructed to resiliently deflect axially towards the second end during insertion of the writing end into the first end without closing or blocking the air vent when the cap is in place on a writing instrument.

9. The vented cap of claim 8 wherein a portion of said sealing member is fixedly mounted to an interior surface of said cap body.

10. A cap for covering the writing end of a writing instrument containing a non-solid writing material, comprising:

a cap body having a first end for receiving the writing end, a second end for covering the writing end, a long axis extending from the first end to the second end, the cap body defining an air flow passage extending from the first end to the second end, and an air vent in communication with the air flow passage; and a sealing member disposed within the cap body including a sealing cap for receiving the tip of the writing instrument and a portion, the sealing cap defining a sealed volume around the tip and the portion being constructed to resiliently deflect along the long axis towards the second end, during insertion of the writing end into the first end, to limit compression of the air within the sealing member without blockage of the air vent when the cap is in place on a writing instrument and to return to its normal position when the cap is removed from the pen.

11. The cap of claim 10 wherein compression of the air is sufficiently limited so that cap pump is substantially prevented even after repeated pumping of the cap on and off.

12. A writing instrument including a pen body having a writing tip and an ink reservoir disposed within the body and in communication with the writing tip, and a cap constructed to receive the writing tip, including a cap body having a first end for receiving the writing tip, a second end for covering the writing tip, a long axis extending from the first end to the second end, and an air vent, the cap body defining an air flow passage extending from the first end to the second end and the air vent in communication with the air flow passage; and a sealing member disposed within the cap body, a portion of the sealing member being fixed axially relative to the long axis of the cap body, the sealing member including a sealing cap for receiving the tip of the writing instrument and a cushioning portion, the sealing cap cooperating with the writing tip to define a sealed volume around the tip and the cushioning portion being constructed to resiliently deflect axially towards the second end without blocking the air vent when the cap is in place on a writing instrument.

13. A writing instrument including a pen body having a writing tip and an ink reservoir disposed within the body and in communication with the writing tip, and a cap constructed to receive the writing tip, including a cap body having a first end for receiving the writing tip, a second end for covering the writing tip, and an air vent; and a sealing member disposed within the cap body, including a sealing cap for receiving the tip of the writing instrument and a cushioning portion, the sealing cap defining a sealed volume around the tip and the cushioning portion constructed to resiliently deflect axially towards the second end during insertion of the writing end into the first end without closing or blocking the air vent when the cap is in place on a writing instrument.

14. A writing instrument including a pen body having a writing tip and an ink reservoir disposed within the body and in communication with the writing tip, and a cap constructed to receive the writing tip, including a cap body having a first end for receiving the writing tip, a second end for covering the writing tip, a long axis extending from the first end to the second end, the cap body defining an air flow passage extending from the first end to the second end, and an air vent in communication with the air flow passage; and a sealing member disposed within the cap body including a sealing cap for receiving the tip of the writing instrument and a portion, the sealing cap defining a sealed volume around the tip and the portion being constructed to resiliently deflect along the long axis towards the second end, during insertion of the writing tip into the first end, to limit compression of the air within the sealing member without blockage of the air vent when the cap is in place on a writing instrument, and to return to its normal position when the cap is removed from the pen body.

15. The cap of claim 1 wherein the cushioning portion is integral with the sealing cap.

16. The cap of claim 1 wherein the sealing cap has a volume of less than 50 $mm^3$.

* * * * *